US006946977B2

(12) United States Patent
Chen et al.

(10) Patent No.: US 6,946,977 B2
(45) Date of Patent: Sep. 20, 2005

(54) PERSONAL RESCUE SYSTEM

(75) Inventors: Kuo-Rong Chen, Panchiao (TW); Chun-Chung Lee, Taipei (TW); Cheng-Hung Huang, Miaoli (TW)

(73) Assignee: Sin Etke Technology Co., Ltd., Taipei (TW)

( * ) Notice: Subject to any disclaimer, the term of this patent is extended or adjusted under 35 U.S.C. 154(b) by 15 days.

(21) Appl. No.: 10/638,358

(22) Filed: Aug. 12, 2003

(65) Prior Publication Data

US 2004/0257210 A1 Dec. 23, 2004

(30) Foreign Application Priority Data

Jun. 17, 2003 (TW) ..... 92116453 A

(51) Int. Cl.[7] ..... G08G 1/123

(52) U.S. Cl. ..... 340/988; 340/990; 340/995.1; 340/426.15; 340/426.19; 340/539.1; 340/539.13

(58) Field of Search ..... 340/988, 990, 340/995.1, 426.15, 426.18, 426.19, 426.22, 539.1, 539.13, 426, 995, 901; 379/37, 38, 59; 307/10.02, 10.06; 342/211; 701/208, 211

(56) References Cited

U.S. PATENT DOCUMENTS 5,543,797 A * 8/1996 Hochstein et al. ..... 340/10.2
5,808,564 A * 9/1998 Simms et al. ..... 340/990
5,942,979 A * 8/1999 Luppino ..... 340/576
6,392,316 B1 * 5/2002 Yoshioka et al. ..... 307/66
6,404,352 B1 * 6/2002 Ichikawa et al. ..... 340/988
6,580,367 B2 * 6/2003 Roach ..... 340/471

* cited by examiner

*Primary Examiner*—Hung Nguyen
(74) *Attorney, Agent, or Firm*—Bacon & Thomas, PLLC

(57) ABSTRACT

A personal rescue system in which the car driver can double-click the emergency button of a personal remote control secretly to send an emergency signal to an on-board movable alert device when extorted by evil fellows, causing the controller of the movable alert device to turn the audio/video output device of the movable alert device into a background mode and then to drive the wireless communication device of the movable alert device to send a rescuing message to a remote side wirelessly under the background mode without infuriating the evil fellows.

14 Claims, 4 Drawing Sheets

PERSONAL RESCUE SYSTEM

BACKGROUND OF THE INVENTION

1. Field of the Invention

The present invention relates to personal rescue system and, more particularly, to such a personal rescue system, which is designed for use with a motor vehicle.

2. Description of Related Art

Conventional personal alarm devices are commonly operated to frighten evil fellows with a loud sharp sound. When held by evil fellows as hostage or when the personal alarm was damaged, other people cannot hear rescuing or alarm voice, or know the location of the victim been held by the evil fellows.

If the driver of a car is held as hostage by an evil fellow in the car, the car driver may use the mobile telephone of the car to dial up the telephone of a friend, relative, or police station for help. However, when dialing the mobile telephone, the communication-related audio/video message, such as hand-free device dialing beep, ringing sound, dialog voice . . . etc. may be heard, or dialing number may be seen on the display by the evil fellow. When infuriated, the evil fellow may threat to hurt the victim.

Further, when received an emergency call for rescue, the victim's friend or relative or the policeman can only be informed of the happenings in the car passively. Because the victim's friend or relative or the policeman cannot actively know the situation in the car, he (she) cannot judge what happened in the car and provide a proper help actively.

Further, the aforesaid car mobile telephone is operative only after the car started. When ACC OFF (ignition switch switched off), the car driver cannot use the car mobile telephone to ask for help. In this case, the car driver can only use one's primordially personal alarm device to frighten evil fellows.

Therefore, it is desirable to have a personal rescue system that eliminates the aforesaid problems.

SUMMARY OF THE INVENTION

It is the main object of the present invention to provide a personal rescue system, which asks for help from people at a remote side and informs the rescuer of the current position data secretly without infuriating the evil fellows when under a background mode.

It is another object of the present invention to provide a personal rescue system, which monitors surrounding sound secretly when under a background mode, so that a proper rescue service can be actively provided.

It is still another object of the present invention to provide a personal rescue system, which guards the person within the communication range of the personal remote control when car engine is off.

To achieve these and other objects of the present invention, the personal rescue system is comprised of a remote control, and a movable alert device. The movable alert device is installed in a motor vehicle. The remote control comprises a wireless transmitter and an emergency button. When threatened, the motor vehicle driver can click the emergency button to drive the wireless transmitter of the remote control to send out an emergency signal corresponding to the emergency button. The movable alert device comprises a global positioning device, a wireless receiver, a wireless communication device, at least one audio/video output device, and a controller. The global positioning device is adapted to calculate the current position data of the movable alert device of the motor vehicle. The wireless receiver is adapted to receive the emergency signal from the wireless transmitter of the remote control. The wireless communication device is adapted to communicate with a remote control center wirelessly. The wireless communication device is defined with an identification code. The controller is electrically connected to the global positioning device, the wireless receiver, the wireless communication device, and the at least one audio/video output device.

When in an emergency case, for example, held by an evil fellow as hostage as ACC ON, the motor vehicle driver can click the emergency button of the remote control secretly, causing the wireless transmitter of the remote control to send out an emergency signal. When the wireless receiver received the emergency signal from the wireless transmitter of the remote control wirelessly, the controller turns the at least one audio/video output device into a background mode under which the controller keeps the at least one audio/video output device from outputting a communication-related message which produced by the wireless communication device when communicating with the remote control center, and then, under the background mode, the controller drives the wireless communication device to send to the remote control center a rescuing message which contains the identification code of the wireless communication device and the current position data of the movable alert device of the motor vehicle, for enabling the remote control center to know who is in the emergency status and where is the person in trouble, so that the urgently needed rescue can be followed.

As indicated above, the controller switches the at least one audio/video output device to the background mode, keeping the at least one audio/video output device from outputting the communication-related message of the wireless communication device during wireless communication action of the wireless communication device. Therefore, the evil fellow does not know that the motor vehicle driver has sent an emergency signal to ask for a rescue from a person at a remote place. When entered the background mode, the at least one audio/video output device keeps outputting regular data as usual without infuriating the evil fellow.

The movable alert device further comprises a microphone adapted to collect surrounding sound in the motor vehicle under the background mode, enabling the data of surrounding sound to be further transmitted to the remote control center wirelessly. Therefore, the remote control center can monitor the situation, and judge what kind of rescue is needed. The on-line monitoring work is achieved by means of the operation of the controller, which controls the wireless communication device to connect to the remote control center actively when entered the background mode. Alternatively, the remote control center may actively connect to the wireless communication device of the movable alert device in the motor vehicle.

The invention further comprises a spare power supply installed in the motor vehicle to provide necessary stand-by working electric power to the wireless receiver and the controller when ACC OFF. When the wireless receiver receives the emergency signal, the controller starts the global positioning device and the wireless communication device via the spare power supply, causing the wireless communication device to send an emergency signal wirelessly during the background mode. Therefore, when ACC OFF, the present invention can still effectively guard the motor vehicle driver when the motor vehicle driver is within the effective communication range of the remote control.

Other objects, advantages, and novel features of the invention will become more apparent from the following detailed description when taken in conjunction with the accompanying drawings.

BRIEF DESCRIPTION OF THE DRAWINGS

FIG. 3 is a flow chart of the personal rescue system according to the first embodiment of the present invention when ACC ON.

DETAILED DESCRIPTION OF THE PREFERRED EMBODIMENT

Figure 1:
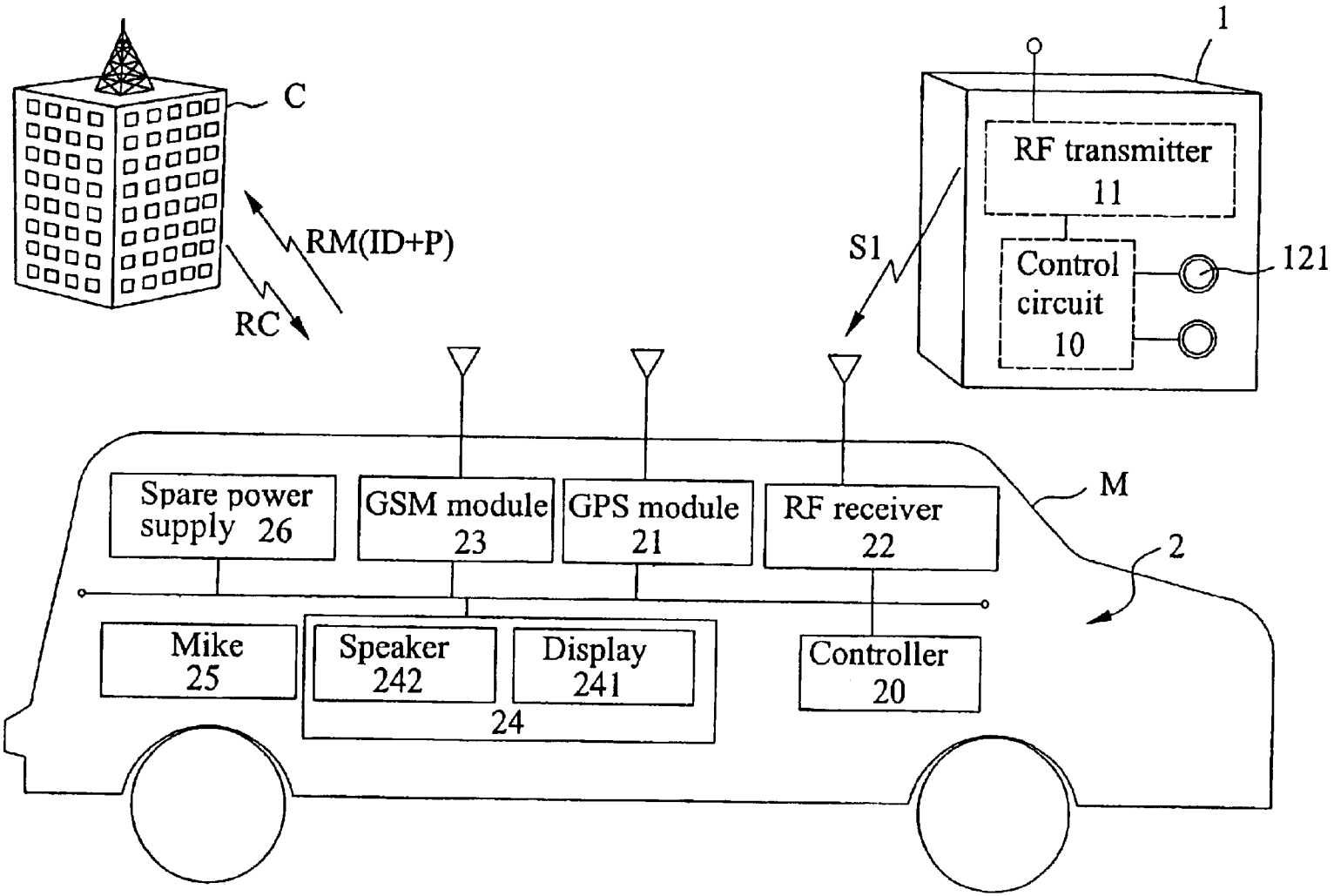
FIG. 1 is a system block diagram of a personal rescue system according to the first embodiment of the present invention.

FIG. 1 is a system block diagram of a personal rescue system according to the first embodiment of the present invention. As illustrated, the personal rescue system comprises a remote control 1, and a movable alert device 2. The movable alert device 2 is installed in a motor vehicle M. The remote control 1 is carried by the driver (owner) of the motor vehicle M to be anywhere.

The remote control 1 comprises a control circuit 10, a RF transmitter 11, and an emergency button 121 on the outside surface.

The movable alert device 2 comprises a controller 20, a global positioning device such as GPS (Global Positioning System) module 21, a wireless receiver such as RF receiver 22, a wireless communication device such as GSM (Global System for Mobile communication) module 23, two audio/video output devices 24 including a display 241 and a speaker 242, a microphone 25, and a spare power supply 26.

Figure 3:
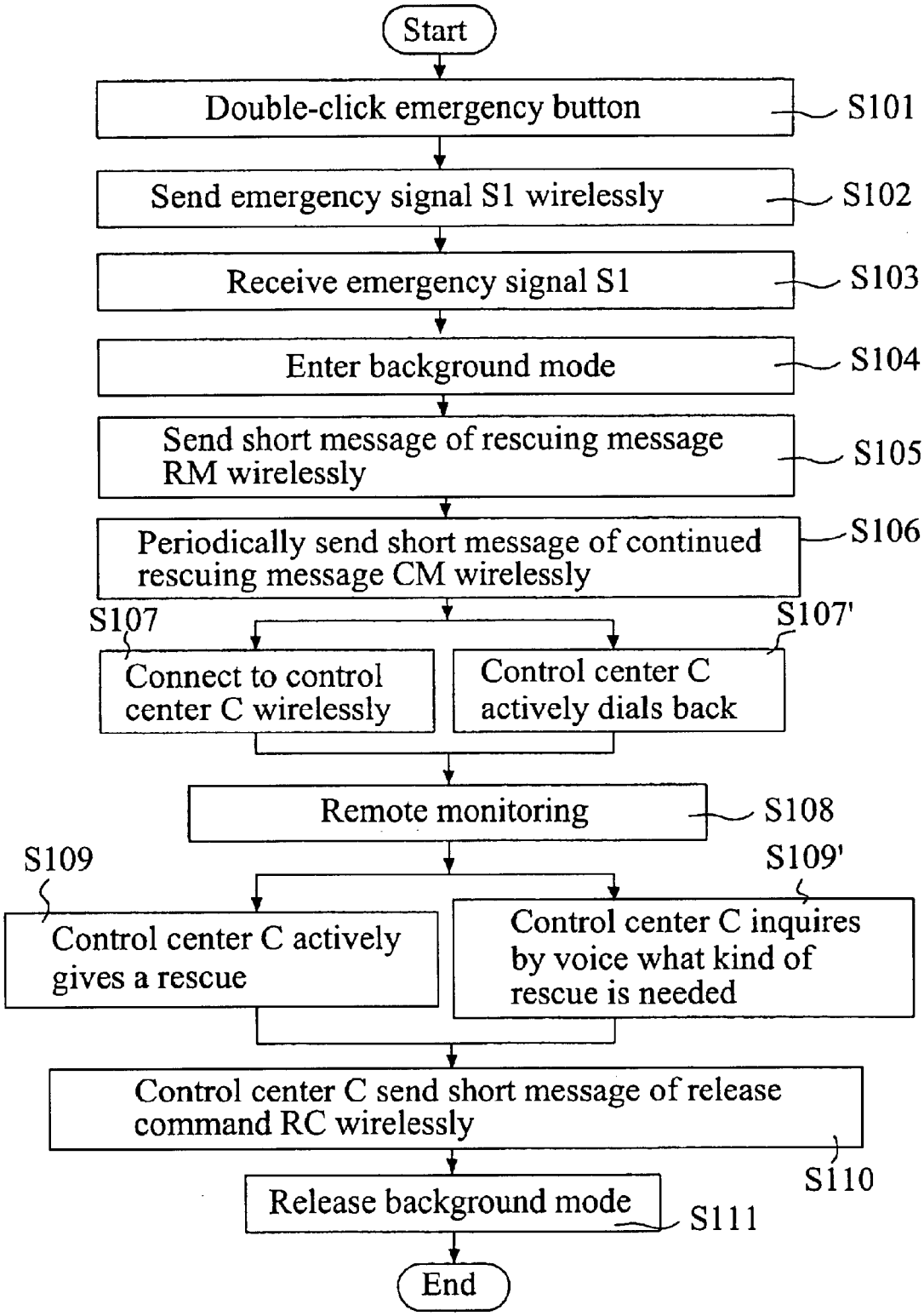

Referring to FIG. 3 and FIG. 1 again, when driving the motor vehicle M, the ACC (car battery power) is ON. If the motor vehicle driver is suddenly extorted by an intruder, the motor vehicle driver can secretly double-click the emergency button 121 of the remote control 1 (Step S101), causing the RF transmitter 11 to send out an emergency signal S1 wirelessly (Step S102).

After the motor vehicle driver double-clicks the emergency button 121, the control circuit 10 detects the double-click action and then drives the RF transmitter 11 to send the emergency signal S1 out. This double-click actuation action prevents a false triggering due to a touch of the emergency button 121 accidentally.

Upon receipt of the aforesaid emergency signal S1 by the RF receiver 22 (Step S103) on-board, the controller 20 turns the speaker 242 and display 241 of the audio/video output devices 24 each into a background mode (Step S104). Under the background mode, the controller 20 fetches the current GPS position data P of the motor vehicle M from the GPS module 21, and controls the GSM module 23 to send a rescuing message RM corresponding to the emergency signal S1 to a remote control center C by means of short message (Step S105). The rescuing message RM contains the current GPS position data P of the motor vehicle M and the ID (Identification) code of the GSM module 23, for example, its telephone number or the corresponding license plate number of the motor vehicle M.

Figure 2:
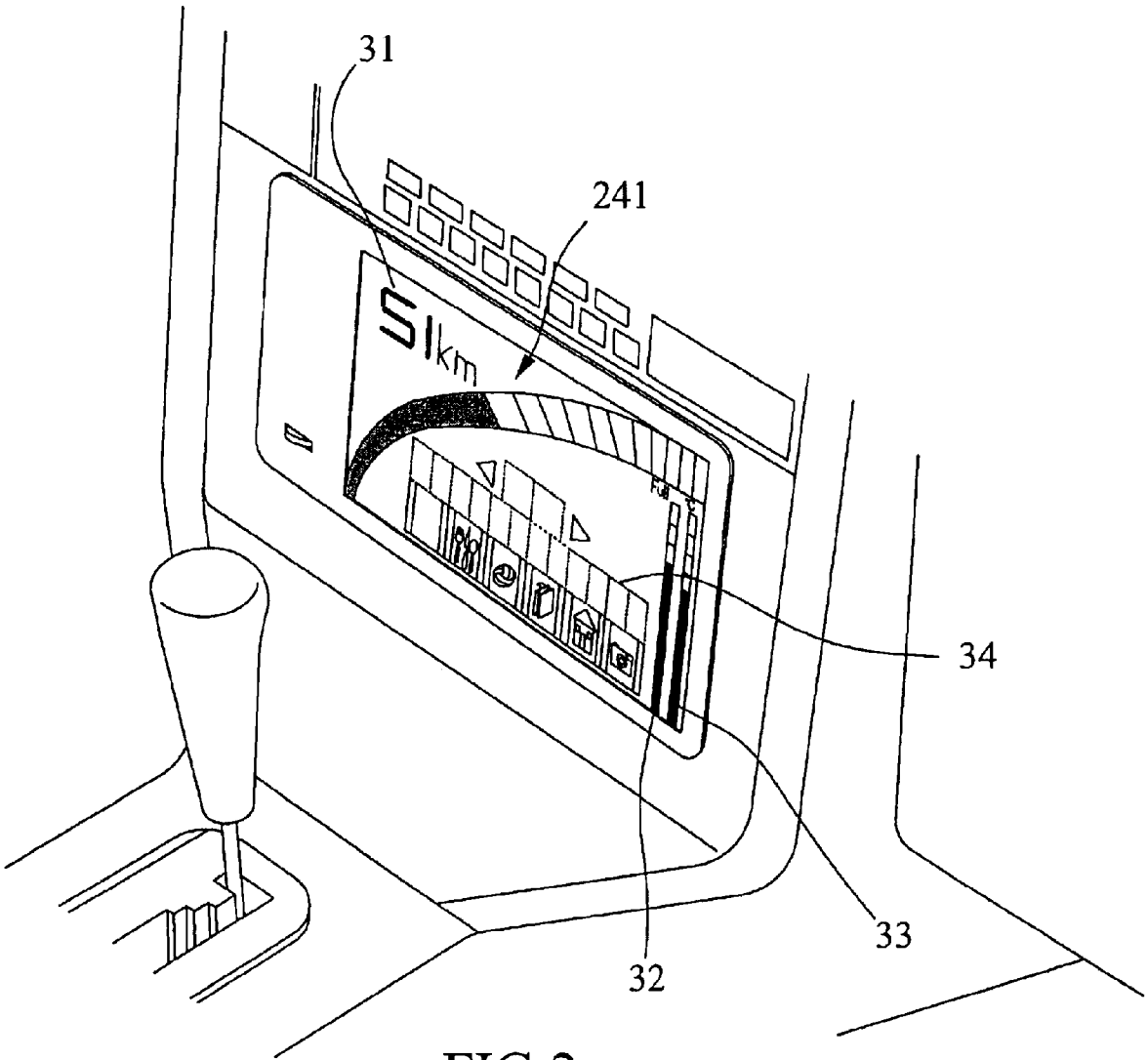
FIG. 2 is a schematic drawing showing the display content of the display of the personal rescue system under the background mode according to the first embodiment of the present invention.

The aforesaid background mode means that the display 241 keeps on displaying regular display messages, for example, car speed scale 31, fuel volume scale 32, water tank temperature scale 33, etc. as usual, see FIG. 2, when the GSM module 23 sends the rescuing message RM out wirelessly; however the display 241 does not display any communication-related video messages of the GSM module 23 on the screen, for example, visible messages such as communication signal strength scale, battery power level, telecommunication domain name, dial display, caller ID, communication time, communication fee, wap browser, etc. Therefore, the dialing display zone 34 in FIG. 2 does not show any visible dialing message.

In the same way, the speaker 242 keeps on broadcasting music as usual when the GSM module 23 sends the rescuing message RM out wirelessly, without broadcasting any communication-related audio message regarding the GSM module 23 of a wireless mobile phone, for example, audio messages such as power-on music, power-off music, dialing beep, call-in ringing, hand-free device communication voice, etc.

When entered the background mode, the controller 20 sends a disable flag to the display 241/speaker 242 to disable the communication interface between the display 241/speaker 242 and the GSM module 23; or the controller 20 sends a mute flag to the hand-free device, driving the speaker 242 into mute mode; or any other equivalent measure may be employed.

When received the rescuing message RM, the remote control center C knows which motor vehicle driver (or motor vehicle) is in trouble, and can immediately send rescuers to the current GPS position data P of the motor vehicle M to rescue the motor vehicle driver, or notify the police department to give urgently needed help to the motor vehicle driver.

As indicated above, when the first embodiment of the present invention under the background mode, the GSM module 23 sends a rescuing message RM to the remote control center C secretly by means of short message; during wireless communication action of the GSM module 23, the communication-related audio/video messages of dialing beep, dialog voice, dial number display, etc., are all hidden and not broadcasted/displayed; and the speaker 242 and display 241 of the movable alert device 2 keep on outputting their primordial audio/video program normally as usual. Therefore, the motor vehicle driver can ask for help from people at a remote side secretly without infuriating the evil fellows who may threat to hurt the motor vehicle driver.

According to this embodiment, the controller 20 further controls the GSM module 23 to further send a series of continued rescuing message CM wirelessly to the remote control center C (Step S106) by short message periodically at a predetermined time interval, for example, 3~5 minutes, if the rescuers not coming yet. The continued rescuing message CM also contains the current GPS position data P of the motor vehicle M and the telephone number (ID code) of the GSM module 23. Therefore, the remote control center C can receive the short message of the continued rescuing message CM periodically, and continuously trace the traveling route of the motor vehicle M subject to the series of different current GPS position data P of the motor vehicle M.

Under the background mode, the controller 20 can also controls the GSM module 23 to automatically dial up the remote control center C (Step S107) or to receive connection from the remote control center C (step S107'), enabling the microphone 25 to collect surrounding sounds such as conversation sounds inside the passenger room, fighting noises, etc., so that the serviceman of the remote control center C can start the monitoring work of listen (Step S108) so as to find out what really happened inside the motor vehicle, and to judge whether immediately dangerous or not, or to judge what kind of rescuing service should be taken immediately (Step S109')?

When the emergency released and the released condition reported to the remote control center C, the remote control center C downloads a release command RC to the GSM module 23 wirelessly (Step S110). Subject to the release command RC, the controller 20 controls the speaker 242 and display 241 of the audio/video output devices 24 to change from the background mode back to the normal output status (Step S111). Alternatively, a release button may be provided at the remote control 1 or a panel of the movable alert device 2 for clicking by the motor vehicle driver to output the release command RC.

According to the present embodiment, the SIM card number, license plate number of the motor vehicle M, ID number of the motor vehicle driver, credit card number, or any ID indicative data may be used for the ID code of the GSM module 23.

A display screen of the mobile telephone of the motor vehicle M or any of a variety of equivalent display devices may be used to substitute for the display 241. A horn, buzzer, or any of a variety of equivalent audio output devices may be used to substitute for the speaker 242. Further, other equivalent microwave, infrared, or radio transmitter/receiver may be used to substitute for the RF transmitter11/RF receiver 22.

Figure 4:
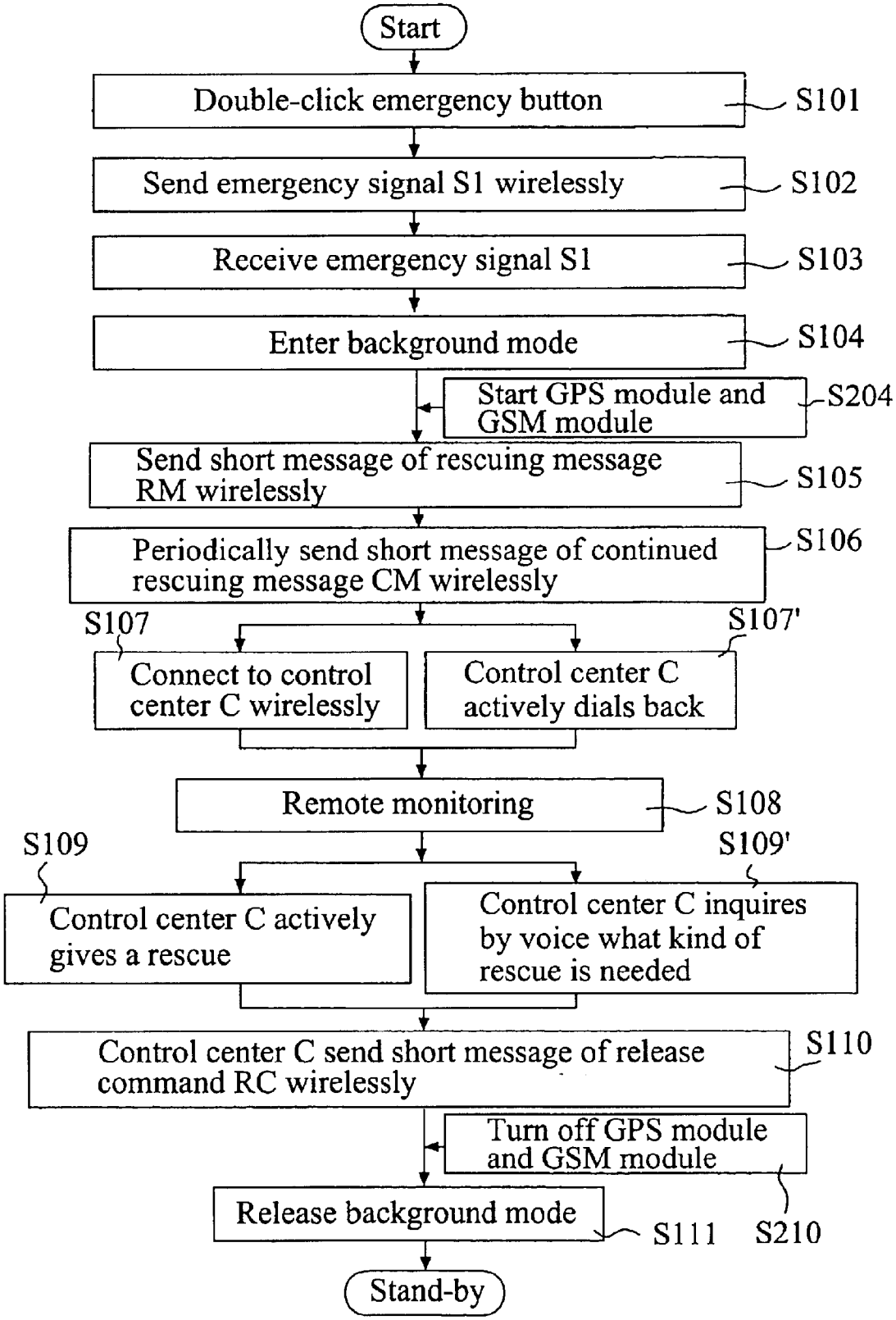
FIG. 4 is a flow chart of the personal rescue system according to the second embodiment of the present invention when ACC OFF.

FIG. 4 is a flow chart of the second embodiment of the present invention. The system block diagram of the second embodiment is same as that shown in FIG. 1. However, this embodiment is to be used when ACC OFF (ignition switch of the motor vehicle switched off) and the motor vehicle driver is gone from the motor vehicle to a place outside the motor vehicle but still within the communication range of the remote control 1.

If the motor vehicle driver is extorted by an evil fellow outside the motor vehicle, the motor vehicle driver can still secretly double-click the emergency button 121 of the remote control 1 (Step S101), causing the RF transmitter 11 to send an emergency signal S1 wirelessly (Step S102). At this time, the battery of the motor vehicle M is off (ACC OFF), however the spare power supply 26 provides the necessary working electric power to the RF receiver 22 and the controller 20 under stand-by status. Therefore, the RF receiver 22 on-board can still receive the emergency signal S1 (Step S103), causing the controller 20 to initiate the speaker 242/display 241 and turns the same into the background mode (Step S104). The controller 20 also immediately starts the GPS module 21 and the GSM module 23 (Step S204) to send a rescuing message RM to a remote control center C by means of short message under power support of the spare power supplier 26 (Step S 105). The following steps are similar to the aforesaid first embodiment of the present invention.

Further, when the emergency released and the released condition reported to the remote control center C, the remote control center C downloads a release command RC to the GSM module 23 wirelessly (Step S110). Thereafter, the controller 20 turns off the GPS module 21 and the GSM module 23 (Step S210) to save power supply of the spare power supplier 26. Subject to the release command RC, the controller 20 also controls the speaker 242 and display 241 of the audio/video output devices 24 to resume from the background mode to the normal output status (Step S111), and then turns off the speaker 242 and display 241.

Therefore, this second embodiment can still effectively guard the safety of the driver within the effective communication range of the remote control 1 when ACC (ignition switch) of the motor vehicle M is off.

A prototype of personal rescue system has been constructed with the features of FIGS. 1~4. The personal rescue system functions smoothly to provide all of the features discussed earlier.

Although particular embodiments of the present invention have been described in detail for purposes of illustration, various modifications and enhancements may be made without departing from the spirit and scope of the invention. Accordingly, the invention is not to be limited except as by the appended claims.

What is claimed is:

1. A personal rescue system comprising a remote control, and a movable alert device installed in a motor vehicle, wherein:

said remote control comprises a wireless transmitter, and an emergency button adapted to drive said wireless transmitter to send out an emergency signal corresponding to said emergency button;

said movable alert device comprises:

a global positioning device adapted to calculate the current position data of said movable alert device of said motor vehicle;

a wireless receiver adapted to receive the emergency signal from said wireless transmitter of said remote control;

a wireless communication device adapted to communicate with a remote control center wirelessly, said wireless communication device being defined with an identification code;

at least one audio/video output device; and a controller electrically connected to said global positioning device, said wireless receiver, said wireless communication device, and said at least one audio/video output device;

wherein, when said wireless receiver receives the emergency signal from said wireless transmitter of said remote control wirelessly, said controller turns said at least one audio/video output device into a background mode under which said controller keeps said at least one audio/video output device from outputting a communication-related message which is produced by said wireless communication device when communicating with said remote control center, and then, under said background mode, said controller drives said wireless communication device to send to said remote control center a rescuing message containing said identification code and the current position data of said movable alert device of said motor vehicle.

2. The personal rescue system as claimed in claim 1, wherein said wireless communication device sends said rescuing message using short messaging.

3. The personal rescue system as claimed in claim 1, wherein under said background mode, said controller further controls said wireless communication device to send a continued rescuing message to said remote control center periodically at a predetermined time interval, said continued rescuing message containing said identification code and the current position data of said movable alert device of said motor vehicle.

4. The personal rescue system as claimed in claim 3, wherein said wireless communication device sends said continued rescuing message using short messaging.

5. The personal rescue system as claimed in claim 1, wherein said movable alert device further includes a microphone.

6. The personal rescue system as claimed in claim 5, wherein under said background mode, said controller further control said wireless communication device to connect to said remote control center wirelessly and to send to said remote control center surrounding sound collected through said microphone.

7. The personal rescue system as claimed in claim 5, wherein under said background mode, said remote control center actively connects to said wireless communication device wirelessly to collect surrounding sound through said microphone.

8. The personal rescue system as claimed in claim 1, wherein under said background mode, said wireless communication device further receives a release command from said remote control center wirelessly, causing said controller to release said background mode from said at least one audio/video output device subject to said release command.

9. The personal rescue system as claimed in claim 8, wherein said remote control center sends said release command by short message.

10. The personal rescue system as claimed in claim 1, wherein said remote control further comprises a control circuit adapted to detect the action of said emergency button and to control said wireless communication device to send said emergency signal when detected a double-clicking of said emergency button.

11. The personal rescue system as claimed in claim 1, wherein said wireless communication device comprises a GSM (Groupe Special Mobile) module.

12. The personal rescue system as claimed in claim 1, wherein said at least one audio/video output device comprises a display.

13. The personal rescue system as claimed in claim 1, wherein said at least one audio/video output device comprises a hands-free device having a speaker.

14. The personal rescue system as claimed in claim 1, wherein said movable alert device further comprises a spare power supply adapted to provide necessary stand-by working electric power to said wireless receiver and said controller when said movable alert device is off.

* * * * *